US006783405B1

(12) United States Patent
Yen

(10) Patent No.: US 6,783,405 B1
(45) Date of Patent: Aug. 31, 2004

(54) TERMINAL FOR ELECTRIC CONNECTOR FOR COMMUNICATION APPARATUS

(75) Inventor: Wu Bin Yen, Taipei Hsien (TW)

(73) Assignee: Chuan Yi Precision Industry Co., Ltd., Taipei Hsien (TW)

( * ) Notice: Subject to any disclaimer, the term of this patent is extended or adjusted under 35 U.S.C. 154(b) by 0 days.

(21) Appl. No.: 10/722,504

(22) Filed: Nov. 28, 2003

(51) Int. Cl.[7] ..... H01R 13/24
(52) U.S. Cl. ..... 439/824; 439/700; 324/754
(58) Field of Search ..... 439/700, 824, 439/862, 65–67, 74; 324/754

(56) References Cited

U.S. PATENT DOCUMENTS 2,612,539 A * 9/1952 Dyer ..... 429/100
2,747,168 A * 5/1956 Arena ..... 439/700
3,335,389 A * 8/1967 Reichardt ..... 439/505
3,555,497 A * 1/1971 Watanabe ..... 439/857
5,348,497 A * 9/1994 Nitescu ..... 439/824
5,366,380 A * 11/1994 Reymond ..... 439/66
5,478,248 A * 12/1995 Mitra et al. ..... 439/74
5,573,435 A * 11/1996 Grabbe et al. ..... 439/862
5,611,717 A * 3/1997 Joly ..... 439/857
5,812,378 A * 9/1998 Fjelstad et al. ..... 361/769
5,865,641 A * 2/1999 Swart et al. ..... 439/482
5,941,739 A * 8/1999 Yoo ..... 439/840
5,954,529 A * 9/1999 Meller ..... 439/188
5,967,856 A * 10/1999 Meller ..... 439/700
6,083,059 A * 7/2000 Kuan ..... 439/862
6,244,911 B1 * 6/2001 Heim ..... 439/862
6,290,524 B1 * 9/2001 Simmel ..... 439/289
6,299,457 B1 * 10/2001 Snyder ..... 439/66
6,464,511 B1 * 10/2002 Watanabe et al. ..... 439/66
2004/0053538 A1 * 3/2004 Villian

* cited by examiner

*Primary Examiner*—Ross Gushi
*Assistant Examiner*—Larisa Tsukerman
(74) *Attorney, Agent, or Firm*—Rosenberg, Klein & Lee

(57) ABSTRACT

A terminal stamped from a phosphor bronze sheet member for electric connector for communication apparatus is disclosed to have two spring coil portions symmetrically bilaterally supported between a protruding contact portion and a mounting plate portion.

1 Claim, 3 Drawing Sheets

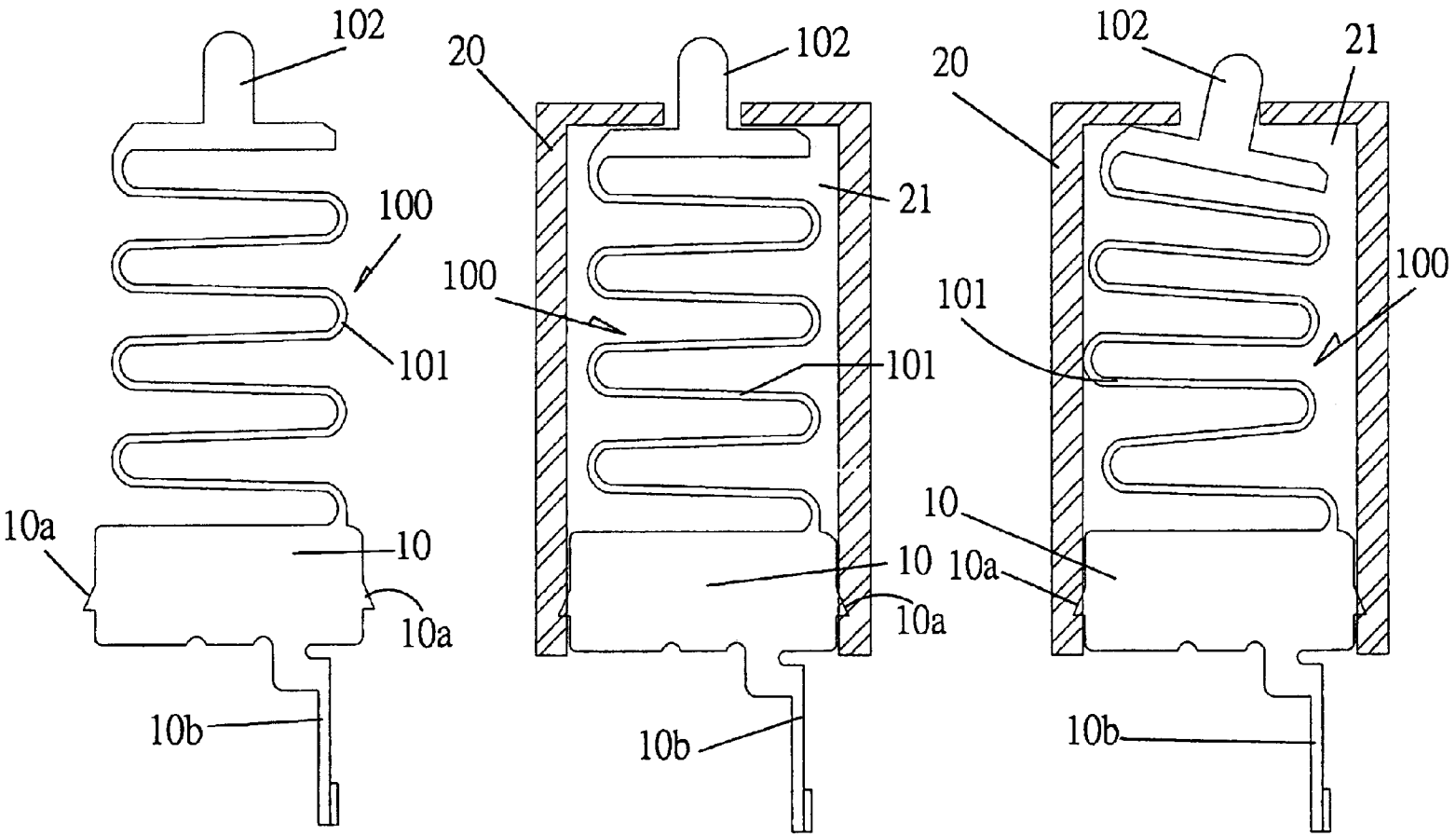
(PRIOR ART)

TERMINAL FOR ELECTRIC CONNECTOR FOR COMMUNICATION APPARATUS

BACKGROUND OF THE INVENTION

1. Field of the Invention

The present invention relates to a terminal for electric connector for communication and, more particularly, to such a terminal that easily positively be positioned in the connector housing for signal transmission without producing much impedance.

2. Description of the Related Art

Communication apparatus are important implement for communication among people at distance. Advanced communication apparatus commonly have a small size with high transmission power. For a compact communication apparatus, the component parts and terminals must be made relatively smaller. FIG. 1 shows a terminal for electric connector for communication apparatus according to the prior art. According to this design, the terminal, referenced by 100, is stamped from a metal sheet member, comprising a protruding contact portion 102 disposed at one end, a mounting plate portion 10 disposed at the other end, a spring coil portion 101 connected between the protruding contact portion 102 and the mounting plate portion 10, a bonding tip 10*b* extended from the bottom side of the mounting plate portion 10 for soldering to a circuit board, and two hooks 10*a* protruding from two opposite lateral sides of the mounting plate portion 10. During installation, the terminal 100 is inserted into the receiving chamber 21 of an electrically insulative housing 20 for electric connector to force the hooks 10*a* into engagement with the inside wall of the housing 20 (see FIG. 1A). When installed, the protruding contact portion 102 extends out of the front opening of the housing 20 for contact. This design of terminal 100 for electric connector is still not satisfactory in function. Due to weak structural strength, the terminal 100 tends to be permanently deformed or damaged during installation of the electric connector (see FIG. 1B).

FIG. 2 shows another structure of terminal for electric connector according to the prior art. This design of terminal is similar to that shown in FIG. 1 with the exception of the two additional parallel side guide strips 103 that are bilaterally extended from the top side of the mounting plate portion 10 in direction reversed to the bonding tip 10*b* and spaced from the spring coil portion 101 at two sides. This structure of terminal is still not satisfactory in function because the protruding contact portion 102 tends to be biased, affecting signal transmission quality. Further, in order to reduce impedance produced during signal transmission, beryllium copper is used for making the terminal. However, a terminal of beryllium copper is relatively expensive.

Therefore, it is desirable to provide a terminal for electric connector for communication apparatus that eliminates the drawbacks of the aforesaid prior art designs.

SUMMARY OF THE INVENTION

The present invention has been accomplished under the circumstances in view. It is the main object of the present invention to provide a terminal for electric connector for communication apparatus, which is durable in use. It is another object of the present invention to provide a terminal for electric connector for communication apparatus, which has low impedance. It is another object of the present invention to provide a terminal for electric connector for communication apparatus, which is inexpensive to manufacture. To achieve these and other objects of the present invention, the terminal is directly stamped from a phosphor bronze sheet member, having protruding contact portion disposed at one end, a mounting plate portion disposed at the other end, and two spring coil portions symmetrically bilaterally supported between the protruding contact portion and the mounting plate portion.

BRIEF DESCRIPTION OF THE DRAWINGS

FIG. 1 is a plain view of a terminal for electric connector for communication apparatus according to the prior art.

FIG. 1A illustrates the terminal of FIG. 1 installed in an electrically insulative housing.

FIG. 1B is similar to FIG. 1A but showing the protruding contact portion biased.

DETAILED DESCRIPTION OF THE PREFERRED EMBODIMENT

Figure 3:
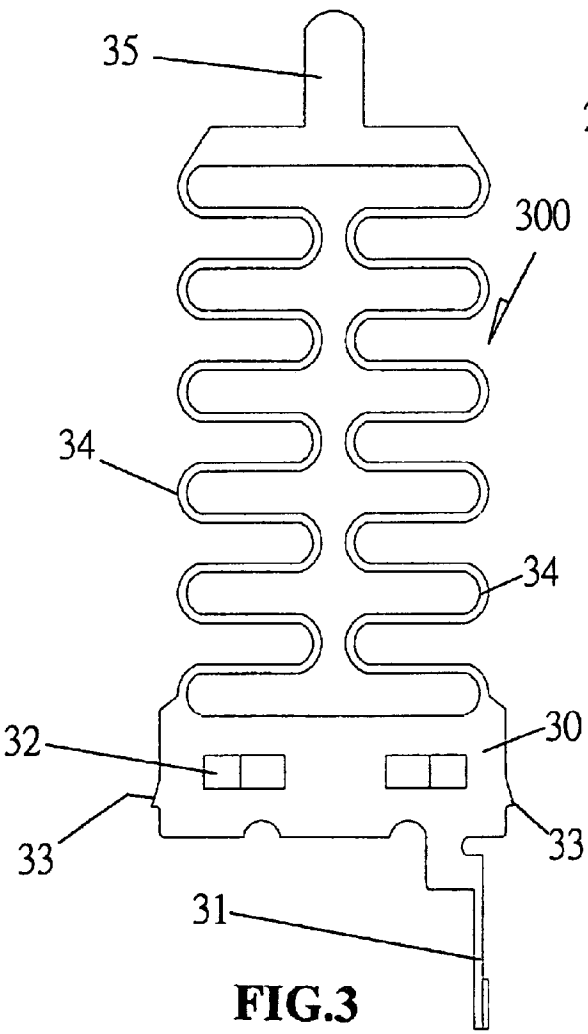
FIG. 3 is a plain view of a terminal for electric connector for communication apparatus according to the present invention.

Referring to FIG. 3, a terminal 300 for electric connector for communication apparatus in accordance with the first embodiment of the present invention is shown comprising a protruding contact portion 35 disposed at one end, a mounting plate portion 30 disposed at the other end, two spring coil portions 34 symmetrically bilaterally connected between the protruding contact portion 35 and the mounting plate portion 30, a bonding tip 31 extended from the bottom side of the mounting plate portion 30 for soldering to a circuit board, two hooks 33 protruding from two opposite lateral sides of the mounting plate portion 30, and two springy retaining strips 32 protruded from the mounting plate portion 30 and spaced between the hooks 33.

Figures 2, 2A, 2B:
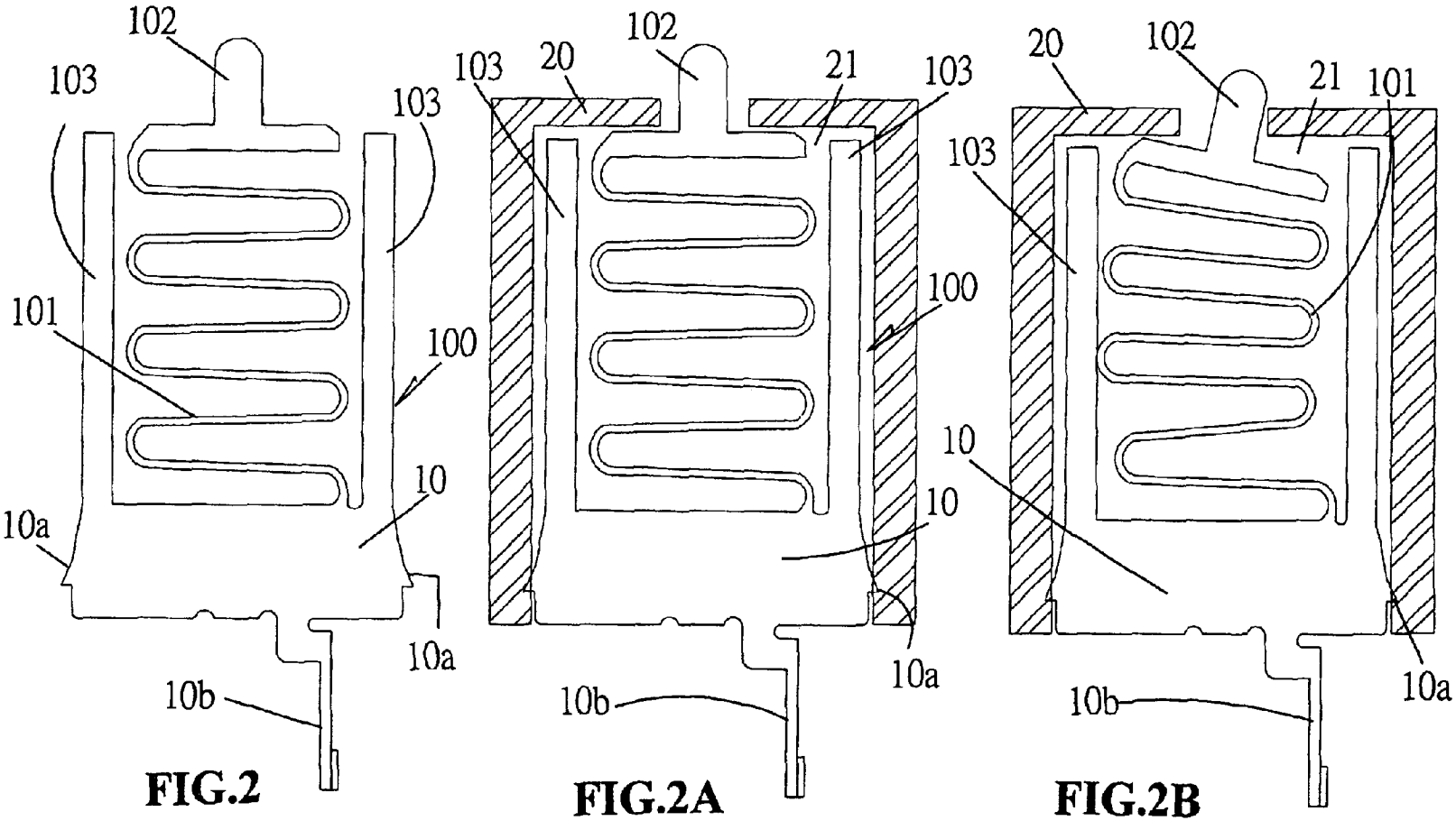
FIG.2 (PRIOR ART)
FIG. 2 is a plain view of a terminal for electric connector for communication apparatus according to the prior art.
FIG. 2A illustrates the terminal of FIG. 2 installed in an electrically insulative housing.
FIG. 2B is similar to FIG. 2A but showing the protruding contact portion biased.
Figure 4:
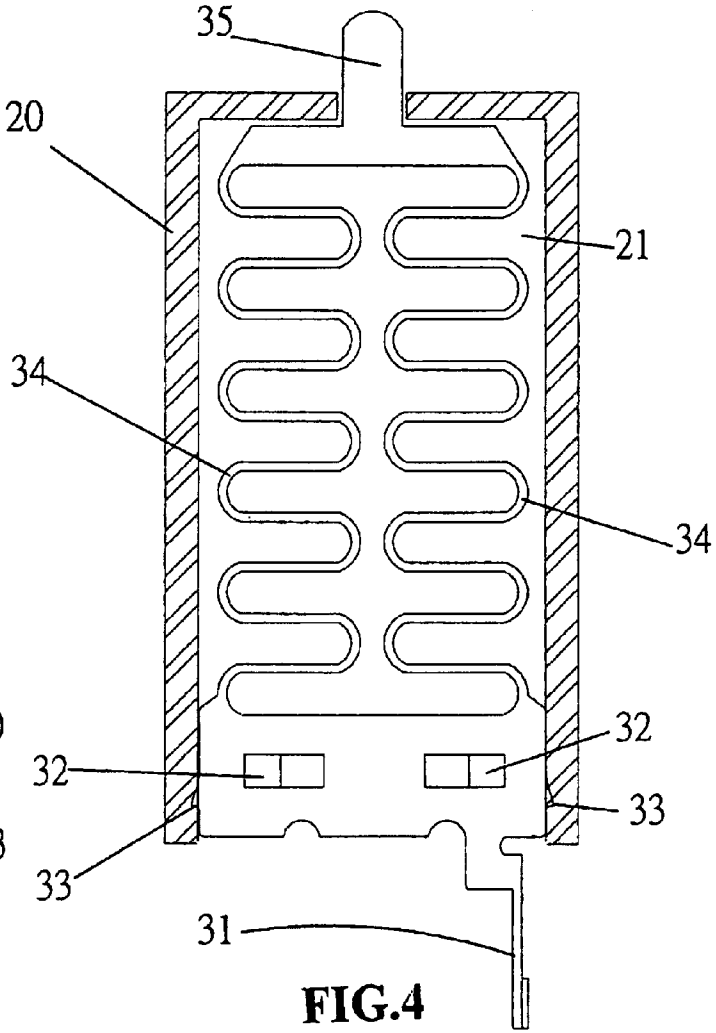
FIG. 4 illustrates the terminal installed in an electrically insulative housing according to the present invention.

Referring to FIG. 4, the terminal 300 is inserted into the receiving chamber 21 of an electrically insulative housing 20 for electric connector to force the springy retaining strips 32 and the hooks 33 into engagement with the inside wall of the housing 20. When installed, the protruding contact portion 35 extends out of the front side of the housing 20, and the two spring coil portions 34 keep the protruding contact portion 35 in balance. Therefore, the use of the electric connector does not cause the protruding contact portion 35 to bias. Further, the terminal 300 is directly stamped from a phosphor bronze sheet member for the advantages of low impedance and low cost.

A prototype of terminal for electric connector has been constructed with the features of FIGS. 3 and 4. The terminal for electric connector functions smoothly to provide all of the features discussed earlier.

Although a particular embodiment of the invention has been described in detail for purposes of illustration, various modifications and enhancements may be made without departing from the spirit and scope of the invention.

Accordingly, the invention is not to be limited except as by the appended claims.

What the invention claimed is:

1. A terminal comprising a protruding contact portion disposed at a first end thereof, a mounting plate portion disposed at a second end thereof, two spring coil portions symmetrically bilaterally connected between said protruding contact portion and said mounting plate portion, a bonding tip extended from a bottom side of said mounting plate portion for soldering to a circuit board, two hooks protruding from two opposite lateral sides of said mounting plate portion for positioning, and two springy retaining strips protruded from said mounting plate portion and spaced between said hooks for positioning.

* * * * *